US011420237B2

(12) United States Patent
Hordley

(10) Patent No.: US 11,420,237 B2
(45) Date of Patent: Aug. 23, 2022

(54) SYSTEM FOR CLEANING METALLIC SCRAPS FROM ORGANIC COMPOUNDS

(71) Applicant: North American Construction Service LTD, Birimingham, AL (US)

(72) Inventor: Timothy Stephen Hordley, West Bromwich (GB)

(73) Assignee: North American Construction Service LTD, Birmingham, AL (US)

( * ) Notice: Subject to any disclaimer, the term of this patent is extended or adjusted under 35 U.S.C. 154(b) by 559 days.

(21) Appl. No.: 16/530,366

(22) Filed: Aug. 2, 2019

(65) Prior Publication Data

US 2020/0122205 A1 Apr. 23, 2020

(30) Foreign Application Priority Data

Jul. 17, 2018 (GB) ..... 1811694

(51) Int. Cl.

| | |
|---|---|
| ***B08B 7/00*** | (2006.01) |
| ***F27B 9/02*** | (2006.01) |
| ***F27D 21/00*** | (2006.01) |
| ***F27B 9/14*** | (2006.01) |
| ***F27B 19/04*** | (2006.01) |
| ***F27B 9/04*** | (2006.01) |

(52) U.S. Cl.

CPC ..... *B08B 7/0085* (2013.01); *F27B 9/028* (2013.01); *F27B 9/045* (2013.01); *F27B 9/14* (2013.01); *F27B 19/04* (2013.01); *F27D 21/00* (2013.01)

(58) Field of Classification Search

CPC ..... B08B 7/0085; F27B 9/028; F27B 9/14; F27B 9/045

See application file for complete search history.

(56) References Cited

U.S. PATENT DOCUMENTS

| | | | | |
|---|---|---|---|---|
| 3,744,779 A | | 7/1973 | Perry | |
| 4,654,088 A | * | 3/1987 | Fitzpatrick | C22B 1/005 134/25.1 |
| 4,784,603 A | * | 11/1988 | Robak, Jr. | C10J 3/723 110/282 |
| 4,789,332 A | * | 12/1988 | Ramsey | C22B 1/005 110/236 |
| 5,170,725 A | * | 12/1992 | Sass | C10J 3/66 432/5 |
| 5,817,163 A | * | 10/1998 | Wood | C22B 7/006 134/40 |
| 6,310,264 B1 | | 10/2001 | Kamst | |

(Continued)

FOREIGN PATENT DOCUMENTS

| | | |
|---|---|---|
| CA | 2112249 A1 | 1/1993 |
| EP | 3106529 A1 | 12/2016 |

(Continued)

OTHER PUBLICATIONS

GB Combined Search and Examination Report for UK Application No. 1811694.7 dated Jan. 28, 2019.

*Primary Examiner* — Nathaniel Herzfeld

(74) *Attorney, Agent, or Firm* — Benesch, Friedlander, Coplan & Aronoff, LLP

(57) ABSTRACT

An installation for melting metallic scraps, and particularly adapted for melting aluminium scraps, includes a system for cleaning the metallic scraps, and in particular for cleaning the scraps from organic compounds.

11 Claims, 3 Drawing Sheets

(56) References Cited

U.S. PATENT DOCUMENTS

| | | | | |
|---|---|---|---|---|
| 8,137,508 | B2 * | 3/2012 | Grispin | C10B 1/08 201/25 |
| 9,702,022 | B2 | 7/2017 | Mansfield et al. | |
| 2017/0051914 | A1 | 2/2017 | Rauch | |

FOREIGN PATENT DOCUMENTS

| | | | |
|---|---|---|---|
| JP | 2001300497 | A | 10/2001 |
| WO | 2017048323 | A1 | 3/2017 |

* cited by examiner

SYSTEM FOR CLEANING METALLIC SCRAPS FROM ORGANIC COMPOUNDS

CROSS REFERENCE TO RELATED APPLICATIONS

This application claims priority to pending United Kingdom Patent Application Serial No. 1811694.7, filed on Jul. 17, 2018, which is incorporated by reference herein in its entirety.

TECHNICAL FIELD

The invention relates to the field of metal cleaning, and more specifically to the cleaning of metallic scraps, such as aluminium scraps. In particular, but not exclusively, the invention relates to a system for cleaning metallic scraps from organic compounds, an installation for melting metallic scraps comprising such system and a method for cleaning metallic scraps using such system.

BACKGROUND

Primary aluminium is mainly produced by the Hall-Héroult process, wherein alumina is electrolyzed in order to produce aluminium. The great development of aluminium production has permitted to use it in a wide range of everyday products, such as beverage cans, food packaging, buildings, and decorations.

The question of the recycling of aluminium products has then naturally arisen. Indeed, the production of primary aluminium consumes considerable amount of energy, so that facilities for producing primary aluminium should be located in a limited number of places, where energy is cheap. Moreover, the treatment of aluminium scraps is also an environmental question.

One major problem when looking for using aluminium scraps in order to reuse aluminium is to clean the scraps. When used, aluminium is in general coated with substances for increasing properties and/or with paints, for instance for decorating the product. The coating comprises organic materials which should be removed before the aluminium is melt, otherwise the materials would contaminate the aluminium bath, causing problem for cleaning the bath and for controlling the melting and producing aluminium of poor quality.

The principle for cleaning scraps involves basically two stages. A first stage is a pyrolysis stage, wherein the coating substances are heated and organic compounds are volatilized. As less oxygen as possible is required in the pyrolysis stage, in order to avoid oxidation of the organic compound. The second stage is a char-removal stage, wherein carbon residues from the pyrolysis stage are burnt in presence of oxygen.

Several technologies have been proposed in order to clean the aluminium scraps.

For instance, one technology is known as multiple-hearths. The scraps enter a so-called roaster, in the form of a vertical cylinder, comprising several zones between two plates, defining hearths. Each hearth comprises a hole. The plates are fixed on the wall of the cylinder. The roaster comprises a central shaft, rotatable with respect to the wall, and onto which rabble arms are mounted. The scraps enter the roaster and fall onto a plate in a first hearth, where they are moved by rabble arms toward the periphery. The scraps then fall through the hole in a second hearth below the first hearth, and are moved by rabble arms toward the centre of the cylinder until they fall through the hole into a third hearth, and so on, until they are discharged out through the bottom of the roaster. Each zone is heated by a multiple burner arrangement. Sealing against air input is made cautiously so that oxidation is minimized. Documents U.S. Pat. No. 9,702,022 and WO 2017/048323 each gives an example of a multiple-hearth roaster.

One problem with the multiple-hearth technology is its complexity. Indeed, the roaster involves rotating parts, so that sealing against air must be made cautiously. The multiplicity of hearths involves multiplicity of controlling means, such as controlling means for temperature, oxygen content and speed of displacement of the scraps, in each hearth, so that the associated costs are high. The roaster is also cumbersome.

Another known technology is the rotary kiln. For instance, as disclosed in document CA 2 112 249, aluminium scraps are fed through a chute to a furnace chamber and travel toward an exit thanks to the rotation of the kiln. Gases are heated in a burner chamber and flow through an inlet duct crossing along the furnace chamber, so that aluminium scraps are heated indirectly by radiation through the duct. Scraps are also heated by direct contact with the gases in the chamber, the gases flowing in the chamber from the output of the duct, at counter flow of the scraps, so that the oxygen content in the gases is adapted to the desired reaction (pyrolysis or char-removal) along the path of the scraps.

Document US 2017/0051914 proposes variation of the rotary kiln, wherein scraps enter a rotary drum at an entry end and are moved toward an exit end. The drum comprises two zones: a low oxygen zone from the entry end and a high oxygen zone to the exit end. The low oxygen zone is provided with low oxygen gas from the entry end, and the high oxygen zone is provided with high oxygen gas from the exit end.

One problem with the rotary kiln technology is that the char-removal stage requires different conditions than the pyrolysis. Indeed, pyrolysis is fundamentally only an increase in the temperature, whereas in the char-removal stage, the contact between the residues and the atmosphere containing oxygen is critical: a better contact between residues and oxygen leads to a better oxidation and improve the efficiency. However, in the rotary kiln, the contact of the scraps with the fumes is treated in the same way in the pyrolysis stage and in the char-removal stage.

SUMMARY

Thus, a new solution overcoming in particular the inconvenient of the cited state of the art is required.

For this purpose, a first object of the invention is to propose a new system for cleaning metallic scraps, such as aluminium scraps, with an increased control on the parameters for the cleaning without increasing the costs.

A second object of the invention is to propose a new system for cleaning metallic scraps with is simple to build.

A third object of the invention is to propose a new system for cleaning metallic scraps with an increased reliability.

A fourth object of the invention is to propose a new system for cleaning metallic scraps which is not cumbersome.

A fifth object of the invention is to propose a new system for cleaning metallic scraps which can easily cooperate to a known melting furnace.

A sixth object of the invention is to propose a new system for cleaning metallic scraps which can be easily integrated in an already implemented installation for melting metallic scraps.

A seventh object of the invention is to propose a new system for cleaning metallic scraps wherein no rotating parts are to be considered for air-sealing matter.

Then, according to a first aspect, the invention proposes a system for cleaning metallic scraps from organic compounds. The system comprises:

At least a first chamber provided with an inlet for the scraps and at least a second chamber provided with an outlet for the scraps, A device for controlling the atmosphere in the first chamber and in the second chamber, the oxygen content in the second being above the oxygen content in the first chamber;

A temperature controller for heating the first chamber at a temperature adapted to provide pyrolysis of at least a part of the organic compounds and for heating the second chamber at a temperature adapted to provide burning of at least a part of residues of the pyrolysis;

A conveying assembly for conveying scraps from the inlet for scraps in the first chamber toward the outlet for scraps in the second chamber;

The conveying comprises at least: a first linear guiding mechanism for conveying substantially longitudinally scraps in the first chamber and a second linear guiding mechanism for conveying substantially longitudinally scraps in the second chamber, a transversal chute between the first chamber and the second chamber, wherein the scraps freely fall from the first chamber in the second chamber; a driving device for driving the first linear guiding mechanism and the second linear guiding mechanism at adjustable speed, the driving device being capable of driving the first guiding mechanism at a different speed than the second linear guiding mechanism, so that the thickness of the layer of scraps in the second chamber is adjustable with regards to the thickness of the layer of scraps in the first chamber.

According to an embodiment, at least one of the first linear guiding mechanism and the second linear guiding mechanism comprises an endless conveying belt upon which the scraps can be conveyed.

According to another embodiment, at least one of the first linear guiding mechanism and the second linear guiding mechanism comprises vibrating plates upon which the scraps can be conveyed.

Advantageously, the system can comprise a height adjustment device for adjusting the transversal dimension of the chute.

The device for controlling the atmosphere can comprise a gases recirculation system comprising an outlet for the gases in the first chamber connected to an inlet for the gases in the second chamber, the temperature controller controlling the temperature and the a device for controlling the atmosphere controlling the content of oxygen of the gases before they enter the second chamber.

According to an embodiment, the system can comprise thickness sensors for sensing the thickness of the scraps on the first linear guiding mechanism and/or on the second linear guiding mechanism.

Advantageously, at least one of the first guiding mechanism and the second guiding mechanism is gas-permeable.

According to an embodiment, the system includes features, such a regulating devices, rendering it especially dedicated to the cleaning of aluminium scraps.

According to a second aspect, the invention also proposes an installation for the melting of metallic scraps comprising a system for cleaning as described here above, and a melting furnace connected to the outlet for the scraps of the system for cleaning, so that the scraps flow from the second chamber of the system for cleaning into the melting furnace.

According to an embodiment, the installation can comprise a scraps crusher connected to the inlet for scraps of the system for cleaning, so that the scraps are crushed before entering the first chamber.

According to a third aspect, the invention also proposes a method for cleaning metallic scraps by use of a system for cleaning as described here above. The method comprises: feeding the scraps by the inlet for the scraps in the first chamber of the system for cleaning; conveying the scraps substantially longitudinally through the first chamber; falling of the scraps in the second chamber along the chute; conveying the scraps substantially longitudinally through the second chamber; removing the scraps by the outlet for the scraps.

The method also comprises: determining a target thickness for the scraps on the second linear guiding mechanism in the second chamber; adjusting the speed of the first linear guiding mechanism and/or of the second linear guiding mechanism in order to reach the target thickness on the second linear guiding means.

According to an embodiment, the target thickness for the scraps on the second linear guiding mechanism is below the thickness of the scraps on the first linear guiding mechanism.

BRIEF DESCRIPTION OF THE DRAWINGS

Other effects and advantages will appear in the following description of preferred embodiments accompanied with the drawings wherein.

DETAILED DESCRIPTION

Figure 1:
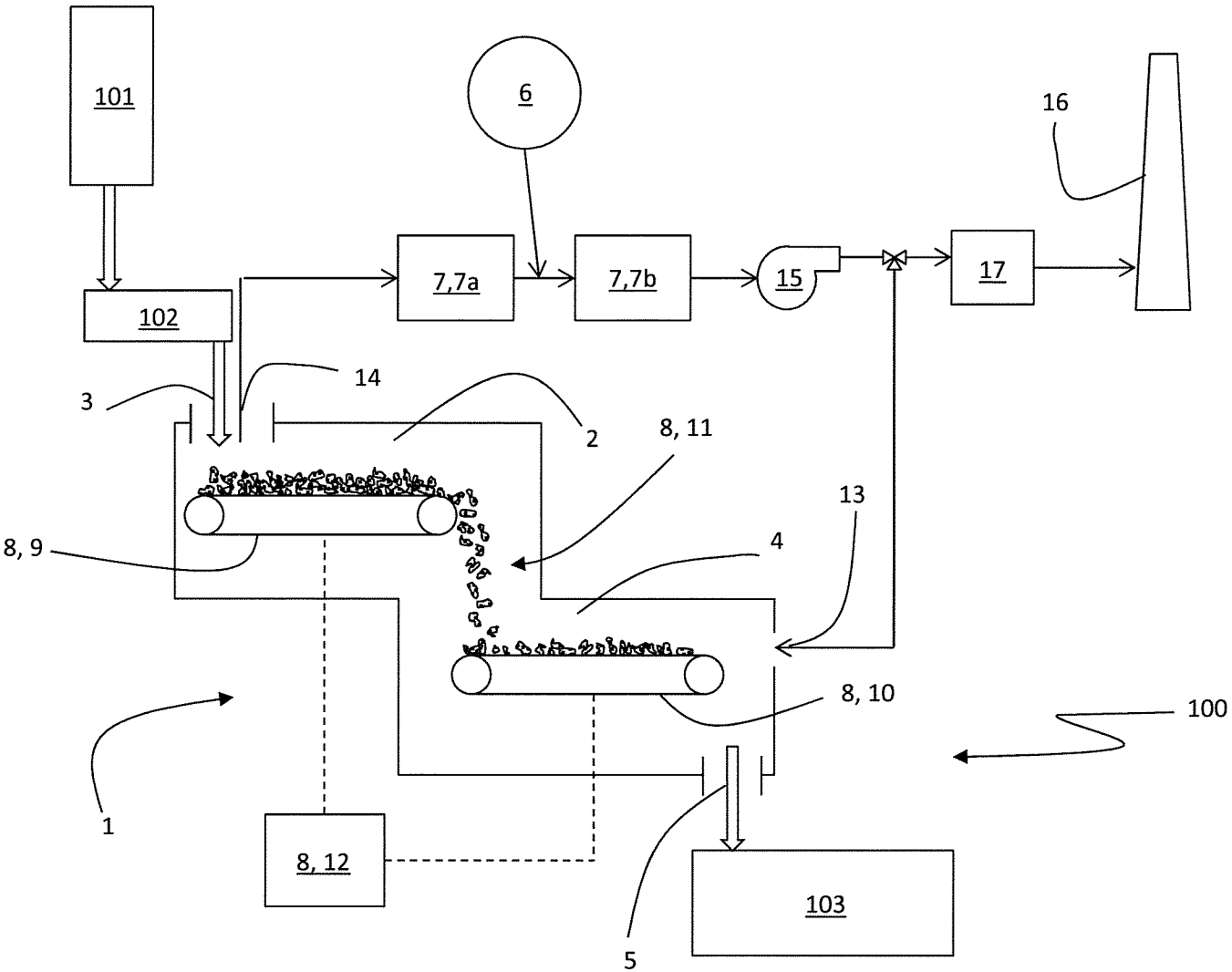
FIG. 1 is a schematic representation of an installation for melting metallic scraps comprising a system for cleaning scraps according to a first embodiment.
Figure 2:
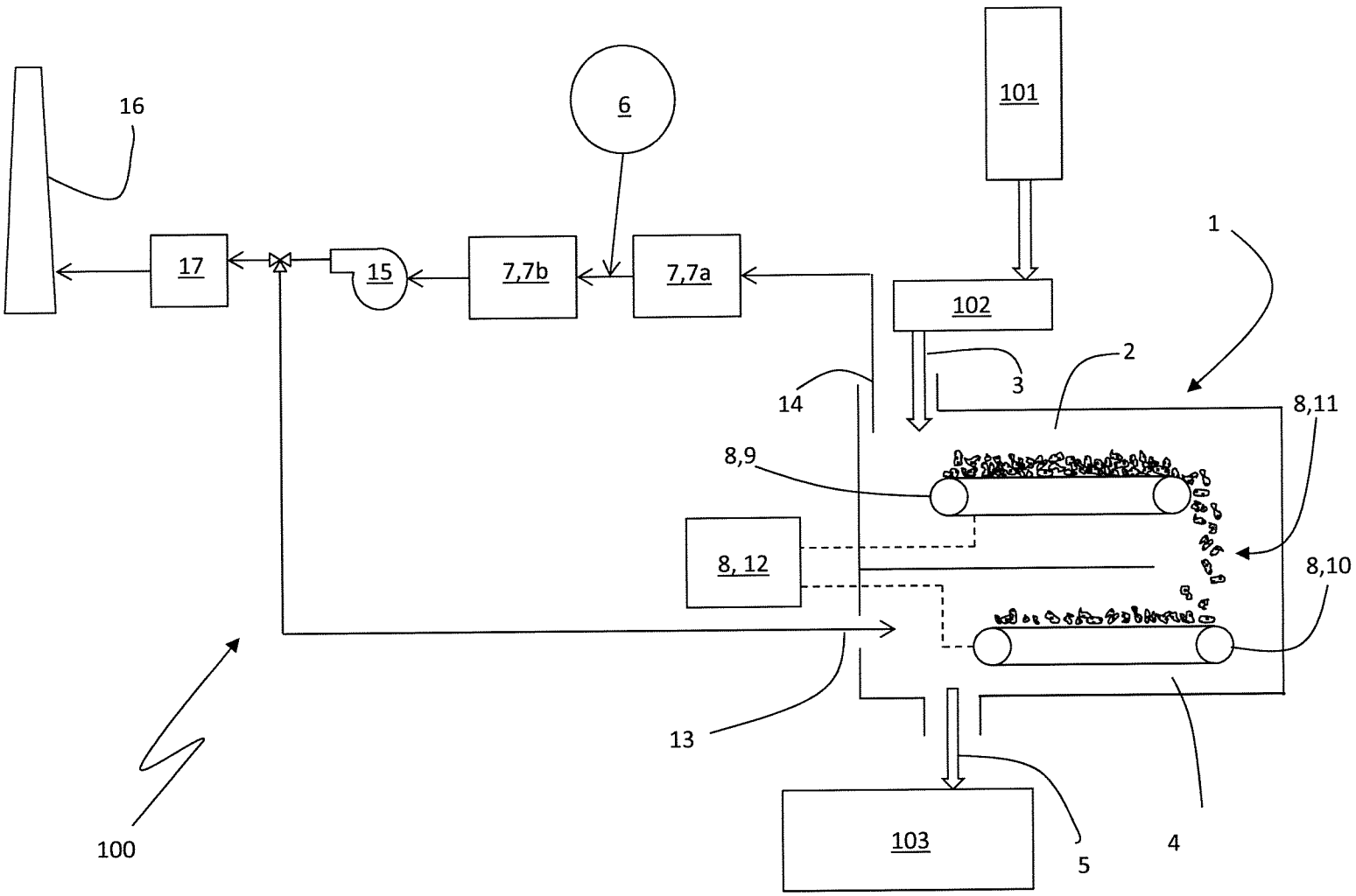
FIG. 2 is similar to FIG. 1, with a system for cleaning metallic scraps according to a second embodiment.

FIGS. 1 and 2 each illustrates schematically an embodiment of an installation 100 for the melting of metallic scraps, and more precisely particularly adapted for melting aluminium scraps. The installation 100 comprises a system 1 for cleaning the metallic scraps, and in particular for cleaning the scraps from organic compounds. The system 1 comprises: at least a first chamber 2 provided with an inlet 3 for the scraps and at least a second chamber 4 provided with an outlet 5 for the scraps, a device 6 for controlling the atmosphere in the first chamber 2 and in the second chamber 4, the oxygen content in the second chamber 4 being above the oxygen content in the first chamber 2; a temperature controller 7 for heating the first chamber 2 at a temperature adapted to provide pyrolysis of at least a part of the organic compounds and for heating the second chamber 4 at a temperature adapted to provide burning of at least a part of residues of the pyrolysis; a conveying assembly 8 for conveying scraps from the inlet 3 in the first chamber 2 toward the outlet 5 in the second chamber 4.

The conveying assembly 8 comprises at least: a first linear guiding mechanism 9 for conveying substantially longitudinally scraps in the first chamber 2 and a second linear guiding mechanism 10 for conveying substantially longitudinally scraps in the second chamber 4, a transversal chute 11 between the first chamber 2 and the second chamber 4, wherein the scraps freely fall from the first chamber 2 in the second chamber 4; a driving device 12 for driving the first linear guiding mechanism 9 and the second linear guiding mechanism 10 at adjustable speed, the driving device 12 being capable of driving the first linear guiding mechanism 9 at a different speed than the second linear guiding mechanism 10, so that the thickness of the layer of scraps in the second chamber 4 is adjustable with regards to the thickness of the layer of scraps in the first chamber 2.

More generally, the installation 100 also comprises a scraps supply, for instance from a feeder 101, connected to the inlet 3 for the scraps of the system 1. For instance, scraps come from consumer products, such as beverage cans, but also from building sector, such as aluminium profiles. If needed, in order to ensure an efficient treatment in the system 1 for cleaning, the installation 100 can comprises a crusher 102 upstream from the inlet 3 for the scraps in the system 1, so that the scraps are crushed to present an optimal size for the cleaning. By crusher, we refer here to any device able to reduce the initial size of the scraps. The installation 100 also comprises a melting furnace 103 connected to the outlet 5 for the scraps of the system 1, so that once the scraps are cleaned, they can be melted in the same installation, as required.

An embodiment of the operations will now be described with reference to FIG. 1 in particular.

The scraps fall from the inlet 3 for the scraps of the system 1 in the first chamber 2, onto the first linear guiding mechanism 9. According to the embodiment of the description, the first linear guiding mechanism 9 is an endless conveying belt, here after referred to as the first belt 9. The belt is preferentially, but not necessarily, gas-permeable. For instance, the belt is meshed.

The scraps are conveyed by the first belt 9 in a first substantially longitudinal direction, that is to say that the point where the scraps arrive on the first belt 9 is longitudinally shifted from the point where the scraps leave the first belt 9. Practically, the longitudinal direction corresponds to the horizontal direction.

We define here after a horizontal direction and a vertical direction by reference to the natural directions relatively to the force of gravity: a horizontal direction is a direction transverse to the force of gravity, the vertical direction being parallel to the force of gravity.

Alternatively, the first belt 9 can be inclined downward or upward, without impacting the operation of the system 1.

The scraps leave the first belt 9 at a longitudinal end of the first belt 9, where they fall freely along the transversal chute 11. More precisely, the chute is an area where the scraps move substantially transversally with no support, that is to say they move vertically downward, under the effect of the gravity on their mass. The scraps can be guided transversally partially along the chute 11. However, the scraps are at least free to fall transversally so that they undergo aeration, as it will be explained further here under.

The scraps fall from the first belt 9 along the chute 11 to the second chamber 4 on the second linear guiding mechanism 10. According to the described embodiment, the second linear guiding mechanism is an endless conveying belt, here after referred to as the second belt 10. The second belt 10 can present, but not necessarily, the same features as the first belt 9. According to the described embodiment, the second belt 10 convey the scraps in the same longitudinal direction as the first belt 9. In other words, the second belt 10 is transversally shifted from the first belt 9, and the scraps are conveyed in the same direction from the input 3 for scraps to the output 5 for scraps.

The transverse distance between the first belt 9 and the second belt 10 is adjustable. More precisely, the system 1 comprises a height adjusting device in order to adjust the transversal dimension of the chute 11. Accordingly, the time during when the scraps fall freely along the chute, and consequently the time of aeration and agitation of the scraps can be adjusted.

The scraps are conveyed by the second belt 10 to the outlet 5 for scraps, where they are for instance conveyed to the melting furnace 103.

The driving device 12 is set to control the speed of the first belt 9 that the scraps undergo a pyrolysis in the first chamber 2, and to control the speed of the second belt 10 so that the scraps undergo a char-removal treatment in the second chamber 4, as it will be explained further here under. The speed of each belt 9, 10 is adjusted in order to get a targeted residence time in each chamber. The speed of each belt can be adjusted independently from each other, so that the pyrolysis stage and the char-removal stage can be considered, in term of residence time, independently.

Figure 3:
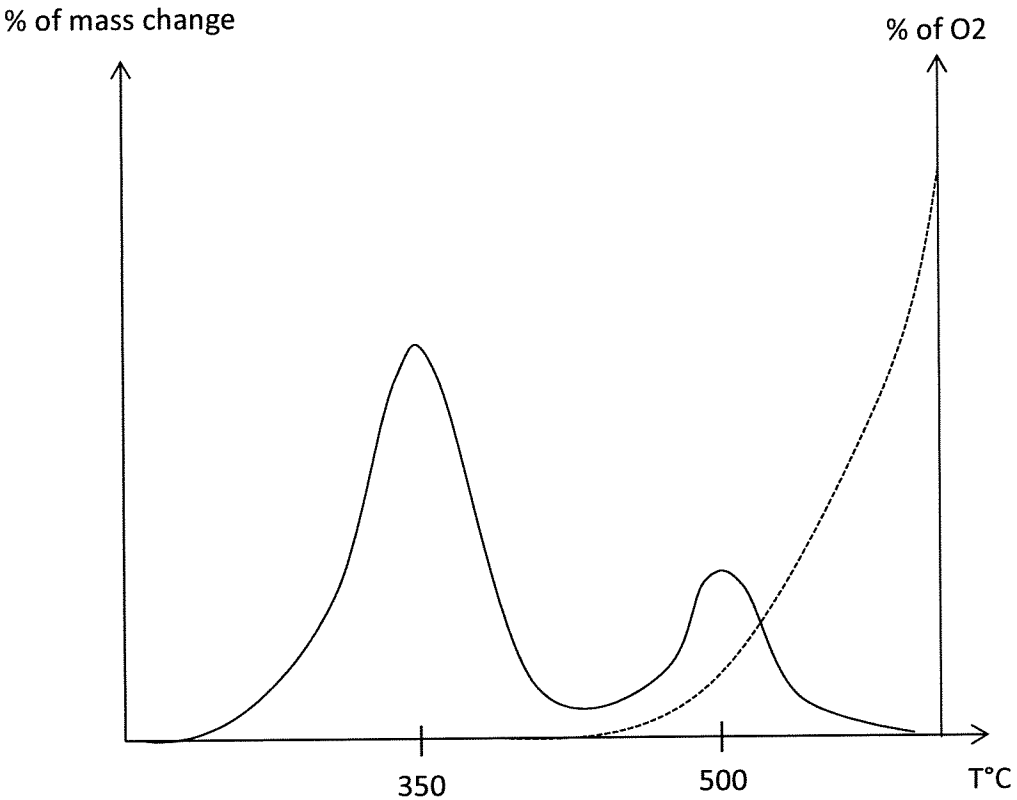
FIG. 3 is a diagram illustrating the evolution of the rate of mass change (continuous line) and of the content of dioxygen (discontinuous line) depending on temperature in the system for cleaning metallic scraps of FIG. 1 or FIG. 2.

FIG. 3 illustrates schematically the rate of mass change of the scraps and the dioxygen level of oxygen in the gases in the system 10 for cleaning, depending on the temperature. In the pyrolysis stage, in the first chamber 4, the level of dioxygen should be as low as possible, even null if possible. When the temperature reaches around 350° C., the organic compounds volatilized, so that the rate of the mass change of the scraps increase to reach a first value. Hydrocarbons residues remain on the scraps. In the second chamber 1, during char-removal stage, the level of dioxygen is enough to provide combustion of the residues, so that the rate of the mass change increase to reach a second value, typically lower than the first value.

The system 1 also comprises a gases recirculation system, for recirculating the gases from an inlet 13 for gases in the second chamber 4 toward an outlet 14 for gases in the first chamber 2, and from the outlet 14 for gases toward the inlet 13 for gases. The device 6 for controlling the atmosphere comprises a dioxygen feeder in order to enrich the gases in dioxygen before they enter at the inlet 13 for the gases in the second chamber 4. More precisely, the gases circulate in a loop the device 6 for controlling the atmosphere is placed between the outlet 14 for gases and the inlet 13 for gases, according to the flow direction of the gases, so that the gases at the inlet 13 for gases contain dioxygen at a controlled level, adapted to provide char-removal in the second chamber 4, and to provide pyrolysis in the first chamber 2. More precisely, the level of dioxygen provided by the device 6 for controlling the atmosphere is adjusted so that nearly all the dioxygen is consumed in the second chamber 4 during char-removal, and so that the level of oxygen in the first chamber is nearly null, or as low as possible. Indeed, the char-removal stage is basically a combustion reaction, requiring the presence of dioxygen. On the contrary, the pyrolysis stage requires a level of dioxygen as low as possible. The gases circulation from the second chamber 4 toward the first chamber 2, with an initially controlled level of dioxygen, at counter-flow with the scraps, provides the required conditions in the first chamber 2 and the second chamber 4 for an efficient cleaning of the scraps.

The device 6 for controlling the atmosphere is also able to provide a control on the pressure of the gases before they enter the second chamber 4.

The speed of the second belt 10 can be adjusted advantageously with respect to the speed of the first belt 10 so that the thickness of the scraps on the second belt is below the thickness of the scraps on the first belt 9. Indeed, char-removal stage is basically a combustion reaction, requiring a contact between the gases rich in dioxygen and the scraps. The pyrolysis stage is basically an increase in temperature, and the contact between the scraps and the gases is not relevant. Then, the thickness on the second belt 10 should be advantageously as low as possible, with a compromise regarding production requirements. By adjusting the speed of the second belt 10 with respect to the speed of the first belt 9, the thickness of the scraps on the second belt is easily adjusted. In that event, the system 1 can comprises sensors for measuring the thickness of the scraps in each chamber 2, 4, and for adjusting the speed of each belt 9, 10 accordingly.

Moreover, the chute 11 between the first belt 9 and the second belt 11 provides an advantageous aeration and agitation of the scraps before they fall on the second belt. It has been observed that such aeration and agitation increase the efficiency of the cleaning. It is supposed that such aeration and agitation provide at least two effects:

First, the organic compounds volatilized during the pyrolysis stage could remain trapped in the layer of scraps on the first belt 9; when they fall along the chute 11, they are freed, so that they are eliminated from the scraps more efficiently; second, the scraps are aerated, no surface of the scraps being in contact with a support, so that most of the surface of each scrap is in contact with the gases, increasing the liberation of volatilized organic compounds and improving the contact with the gases for instance for finishing char-removal stage if dioxygen has not already been totally consumed in the second chamber 10; it results that the level of dioxygen in the first chamber 2 can be as low as possible.

Moreover, the temperature controller 7 comprises a burner 7*a* placed between the outlet 14 for gases and the inlet 13 for gases, and before the device 6 for controlling the atmosphere according to the flow direction of the gases, so that the gases exiting the system 1 enter the burner 7*a* where the volatilized organic compounds from the pyrolysis can be burnt. The gases, cleaned at least partially from the volatilized organic compounds, are consequently heated by the burning process in the burner, and can be sent back in the system 1, in the second chamber 4. In the event that the temperature of the gases after the burner 7*a* is not adapted for the char-removal in the second chamber 4, the temperature controller 7 can comprises a heat exchanger 7*b*.

For instance, if the temperature of the gases is too high after the burner 7*a*, and even after the dilution by dioxygen from the device 6 for controlling atmosphere, the heat exchanger 7*b* can advantageously cool the gases, and in the same time recover part of the heat.

The level of dioxygen and the temperature of the gases at the inlet 13 for gases depend in particular on the sizing of the system 1, and the required residence time in each chamber 2, 4. For instance, set points for dioxygen level and set points for temperature at the inlet 13 for gases and at the outlet 14 for gases can be determined, and the device 6 for controlling the atmosphere and the temperature controller 7 can be set accordingly. Temperature sensors and dioxygen measuring devices can be implemented in the system 10 in order to provide an increase control.

The gases can be vented by a fan 15 allowing the circulation of the gases. Part of the gases can be rejected to the atmosphere through a stack 16. A second heat exchanger 17 could be placed upstream to the stack 16 for heat recovery consideration. Alternatively, a cleaning device can also be implemented before releasing the gases to the atmosphere.

FIG. 2 illustrates another embodiment of the system 1 represented on FIG. 1 and as described here above. In this embodiment, all the other features being identical to those of the embodiment of FIG. 1, the conveying direction of the second belt 9 is contrary to the conveying direction of the first belt 9. Consequently, the second belt 10 extends under the first belt 9, so that the dimension in the longitudinal direction is reduced when compared with the embodiment of FIG. 1.

According to another embodiment, not represented, the system 1 for cleaning comprises three linear guiding mechanisms, that is to say, when compared to the embodiments of FIGS. 1 and 2, that a third linear guiding mechanism is implemented between the first linear guiding mechanism 9 and the second linear guiding mechanism 10. A chute, as the chute 11 already described, can be implemented between each linear guiding mechanism, so that the system 1 comprises two chutes. With a third, intermediate linear guiding mechanism, an intermediate zone can be created as a transition between the pyrolysis stage and the char-removal stage. The efficiency of the pyrolysis can be increased, as more dioxygen can be consumed in the intermediate zone. Moreover, by providing two chutes, the effects of agitation and aeration are also increased.

The linear guiding mechanisms could comprise any other mechanism than the endless belt, providing a linear displacement in the longitudinal direction with a control on the speed of displacement of the scraps. For instance, they could comprise vibrating plates or walking plates. The linear guiding mechanisms could also include the formation of a fluidized or semi-fluidized bed, favouring the contact between the scraps and the gases.

The invention claimed is:

1. A system for cleaning metallic scraps from organic compounds comprising:

a first chamber provided with an inlet for the scraps and a second chamber provided with an outlet for the scraps, a device for controlling the atmosphere in the first chamber and in the second chamber, the oxygen content in the second chamber being above the oxygen content in the first chamber;

a temperature controller for heating the first chamber at a temperature adapted to provide pyrolysis of at least a part of the organic compounds and for heating the second chamber at a temperature adapted to provide burning of at least a part of residues of the pyrolysis;

a conveying assembly for conveying scraps from the inlet for scraps in the first chamber toward the outlet for scraps in the second chamber; the conveying assembly comprising:

a first linear guiding mechanism for conveying scraps in the first chamber and a second linear guiding mechanism for conveying scraps in the second chamber, a transversal chute between the first chamber and the second chamber, wherein the scraps freely fall from the first chamber to the second chamber;

a driving device for driving the first linear guiding mechanism and the second linear guiding mechanism at adjustable speed, the driving device being capable of driving the first guiding mechanism at a different speed than the second linear guiding mechanism, so that the thickness of the layer of scraps in the second chamber is adjustable with regards to the thickness of the layer of scraps in the first chamber.

2. The system according to claim 1, wherein at least one of the first linear guiding mechanism and the second linear guiding mechanism comprises an endless conveying belt upon which the scraps can be conveyed.

3. The system according to claim 1, wherein at least one of the first linear guiding mechanism and the second linear guiding mechanism comprises vibrating plates upon which the scraps can be conveyed.

4. The system according to claim 1, comprising a height adjustment device for adjusting the transversal dimension of the chute.

5. The system according to claim 1, wherein the device for controlling the atmosphere comprises a gases recirculation system comprising an outlet for the gases in the first chamber connected to an inlet for the gases in the second chamber, the temperature controller controlling the temperature and the device for controlling the atmosphere controlling the content of oxygen of the gases before they enter the second chamber.

6. The system according to claim 1, comprising thickness sensors for sensing the thickness of the scraps on the first linear guiding mechanism and/or on the second linear guiding mechanism.

7. The system according to claim 1, wherein at least one of the first guiding mechanism and the second guiding mechanism is gas-permeable.

8. The system according to claim 1, further comprising a melting furnace connected to the outlet for the scraps of the system for cleaning, so that the scraps flow from the second chamber of the system for cleaning into the melting furnace.

9. The system according to claim 1, further comprising a scraps crusher connected to the inlet for scraps of the system for cleaning, so that the scraps are crushed before entering the first chamber.

10. A method for cleaning metallic scraps by use of a system for cleaning according to claim 1, comprising:

feeding the scraps by the inlet for the scraps in the first chamber of the system for cleaning;

conveying the scraps substantially longitudinally through the first chamber;

falling of the scraps in the second chamber along a chute;

conveying the scraps substantially longitudinally through the second chamber;

removing the scraps by the outlet for the scraps;

the method being characterized in that it comprises:

determining a target thickness for the scraps on the linear guiding mechanism in the second chamber; and adjusting the speed of first linear guiding mechanism in the first chamber and/or of the second linear guiding mechanism in order to reach the target thickness on the second linear guiding mechanism.

11. The method according to claim 10, wherein the target thickness for the scraps on the second linear guiding mechanism is below the thickness of the scraps on the first linear guiding mechanism.

* * * * *